US006223360B1

(12) United States Patent
Lu

(10) Patent No.: US 6,223,360 B1
(45) Date of Patent: May 1, 2001

(54) WATER THERAPY APPARATUS

(76) Inventor: Chien-Hao Lu, 2F, No. 180, Hsiow Lang Rd., Sec. 2, Yung Ho City, Taipei Hsien (TW)

( * ) Notice: Subject to any disclaimer, the term of this patent is extended or adjusted under 35 U.S.C. 154(b) by 0 days.

(21) Appl. No.: 09/558,843

(22) Filed: Apr. 27, 2000

(30) Foreign Application Priority Data

May 5, 1999 (TW) ..... 88207103

(51) Int. Cl.[7] ..... A47K 3/28
(52) U.S. Cl. ..... 4/603; 4/596; 4/613
(58) Field of Search ..... 4/596, 599, 602, 4/603, 613, 256.1, 292; 239/502, 569, 575, 590

(56) References Cited

U.S. PATENT DOCUMENTS 689,164 * 12/1901 Castle ..... 4/599
743,616 * 11/1903 Butcher ..... 4/603
2,567,506 * 9/1951 Bowman ..... 4/603 X
3,080,568 * 3/1963 Burnett ..... 4/599 X
5,608,927 * 3/1997 Lowry et al. ..... 4/603 X
5,947,157 * 9/1999 Kindersley ..... 138/45
6,119,965 * 9/2000 Chang ..... 239/500 X

* cited by examiner

*Primary Examiner*—Robert M. Fetsuga
(74) *Attorney, Agent, or Firm*—Bacon & Thomas, PLLC

(57) ABSTRACT

A water therapy apparatus includes a casing holding a liquid, the casing having an overflow port, a drain port, and an upwardly extended water pipe, a motor-pump controlled to pump the liquid from the casing into the water pipe, a control valve mounted on one end of the upwardly extended water pipe remote from the casing for causing the liquid passing through the upwardly extended water pipe to form a waterfall falling toward the casing, a meshed wooden plate mounted in the casing at a top side on which the user sits to receive the striking of the waterfall coming from the control valve, and a control device mounted on the outside of the casing for controlling the motor-pump to pump the liquid from the casing into the upwardly extended water pipe for producing a waterfall.

10 Claims, 4 Drawing Sheets

WATER THERAPY APPARATUS

BACKGROUND OF THE INVENTION

The present invention relates to a water therapy apparatus, and more particularly to such a water therapy apparatus, which pumps a liquid through an overhead control valve to produce a waterfall for striking the body of the user to stimulate the circulation of blood.

Frequently working on the table, operating a computer, playing a TV game may cause the muscles or joints of the body to ache. In order to have a good health, it is recommended to exercise the body regularly. However, most people have little time to exercise the body regularly. Some people may use mechanical apparatus to exercise the body, enabling the body to work better. There are also known several commercially available water therapy apparatus for use to treat the body physically. These water therapy apparatus commonly use water nozzle means to produce high-pressure flow(s) of water for pounding on the user's body to stimulate the circulation of blood.

SUMMARY OF THE INVENTION

The present invention provides a water therapy apparatus, which stimulates the circulation of blood by pounding a waterfall on the user's body. According to one aspect of the present invention, the water therapy apparatus comprises a casing holding a liquid, a motor-pump controlled to pump the liquid through an overhead control valve, causing the liquid to form a waterfall for pounding on the user's body. According to another aspect of the present invention, the water therapy apparatus further comprises a meshed wooden plate mounted in the casing at topside on which the user sits to receive the striking of the waterfall coming from the control valve.

DETAILED DESCRIPTION OF THE PREFERRED EMBODIMENT

Figure 1:
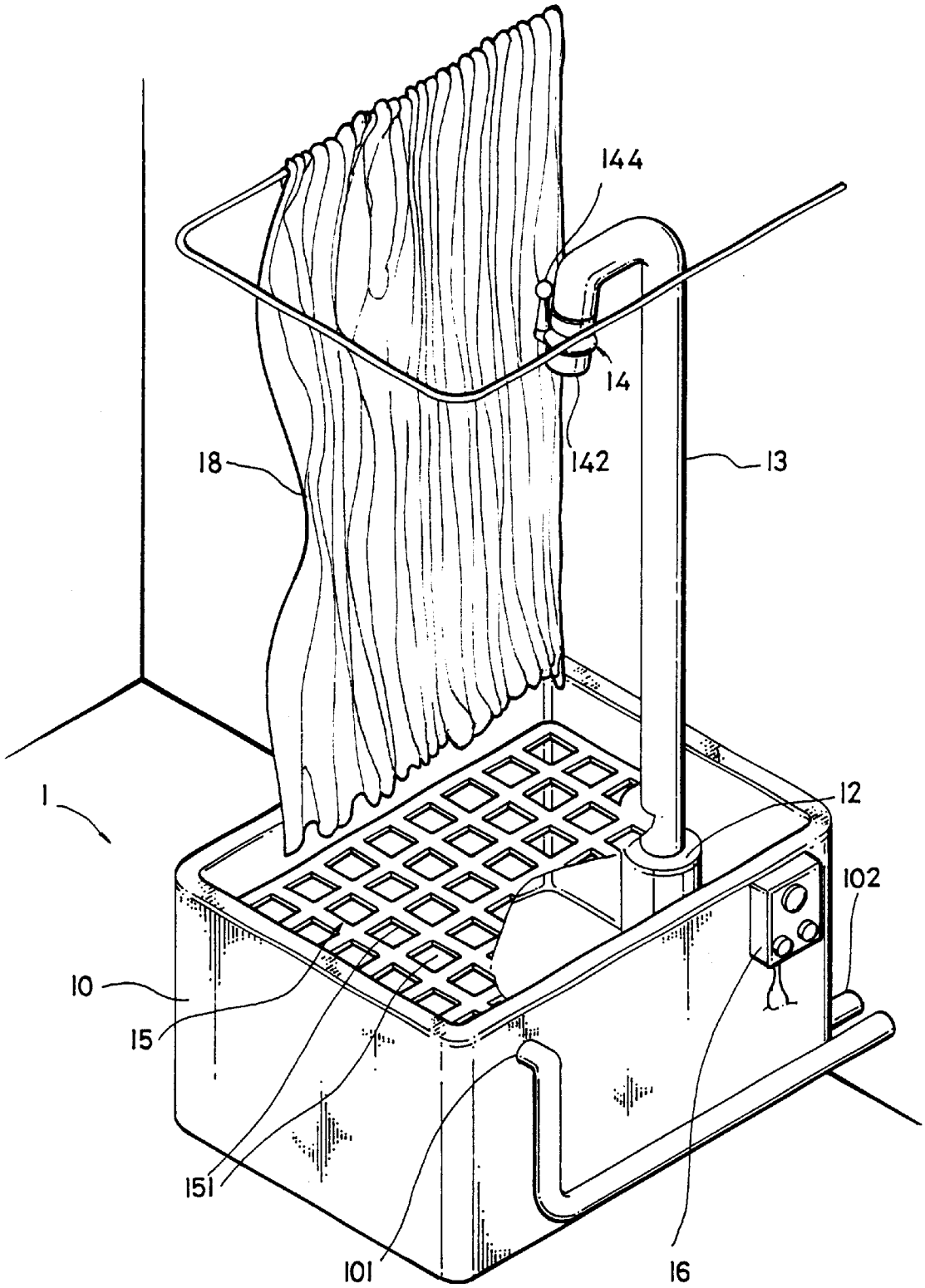
FIG. 1 is a perspective view of a water therapy apparatus according to the present invention.

Referring to FIGS. from 1 through 4, a water therapy apparatus 1 is shown comprising a casing 10 holding a liquid. The casing 10 comprises an overflow port 101 on one vertical side wall thereof near the top for enabling the excessive liquid to flow out of the casing 10, a drain port 102 at the bottom of a second vertical side wall thereof for guiding the liquid out of the casing 10 when changing the liquid or washing the casing 10. The casing 10 has a bottom sidewall sloping downwards toward the drain port 102, so that the liquid flows smoothly out of the casing 10 through the drain port 102 when opening the drain port 102.

Figure 2:
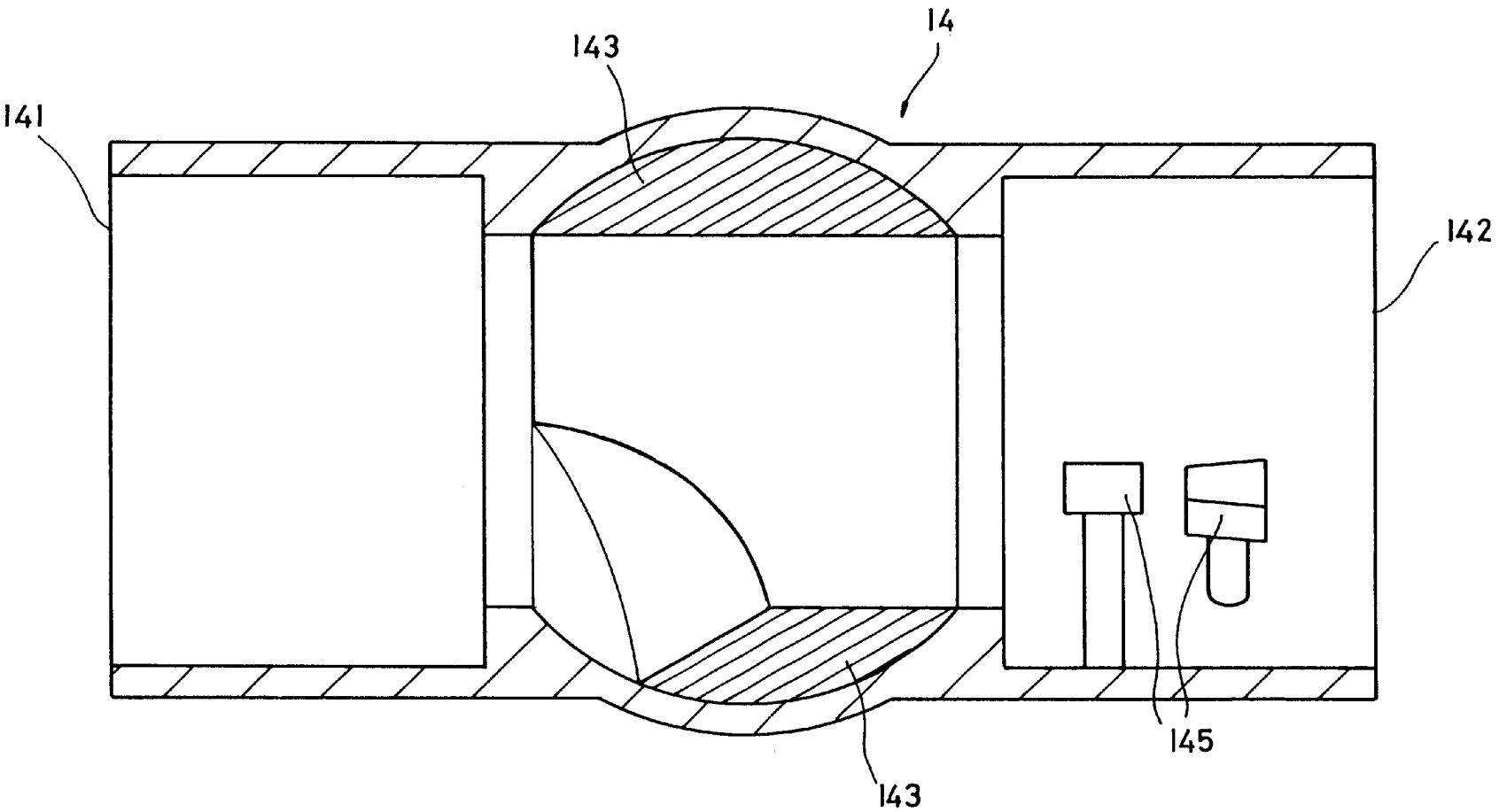
FIG. 2 is a sectional view of a control valve for the water therapy apparatus according to the present invention.
Figure 3:
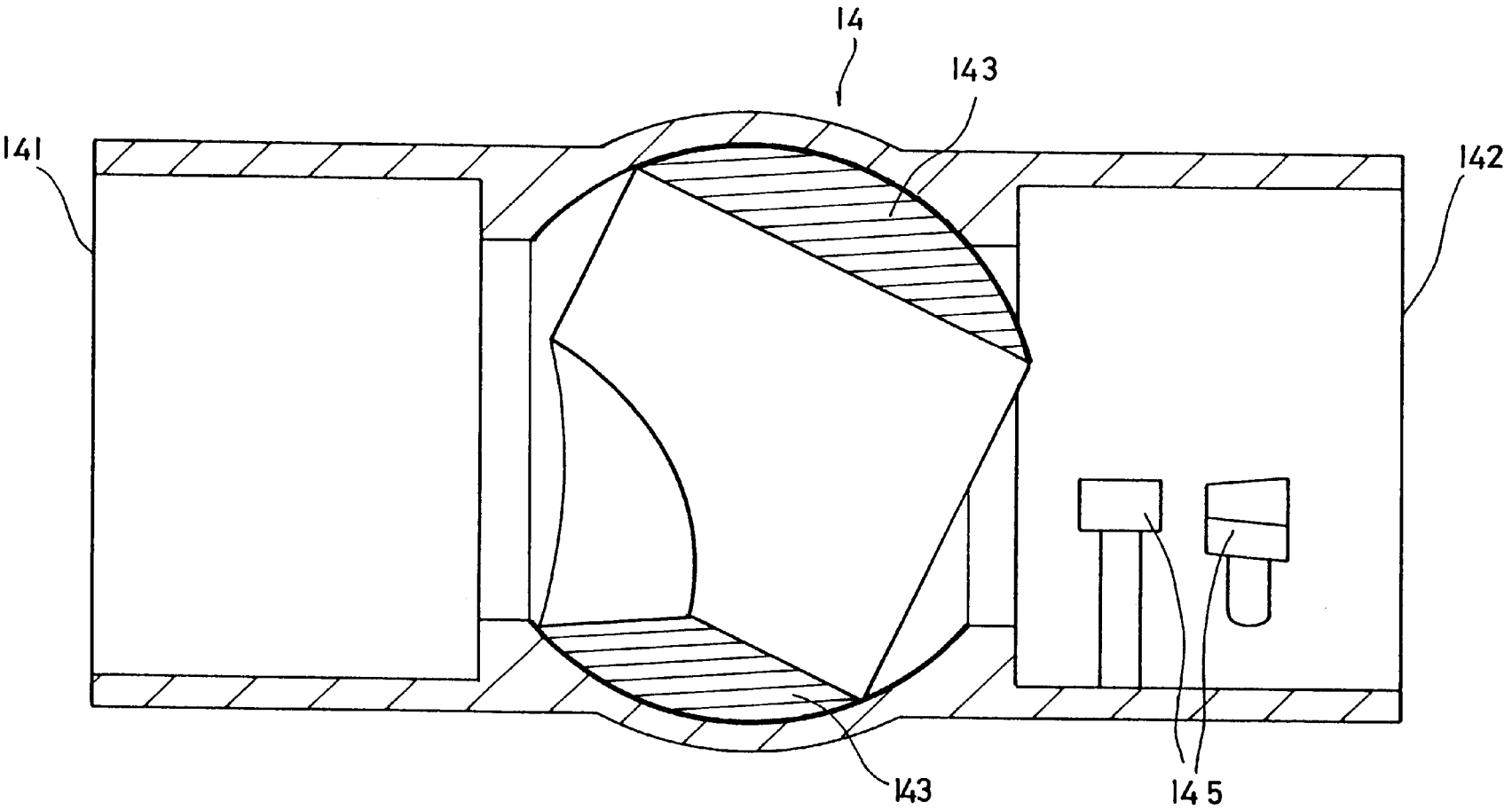
FIG. 3 is similar to FIG. 2 but showing the angular position of the valve block adjusted.
Figure 4:
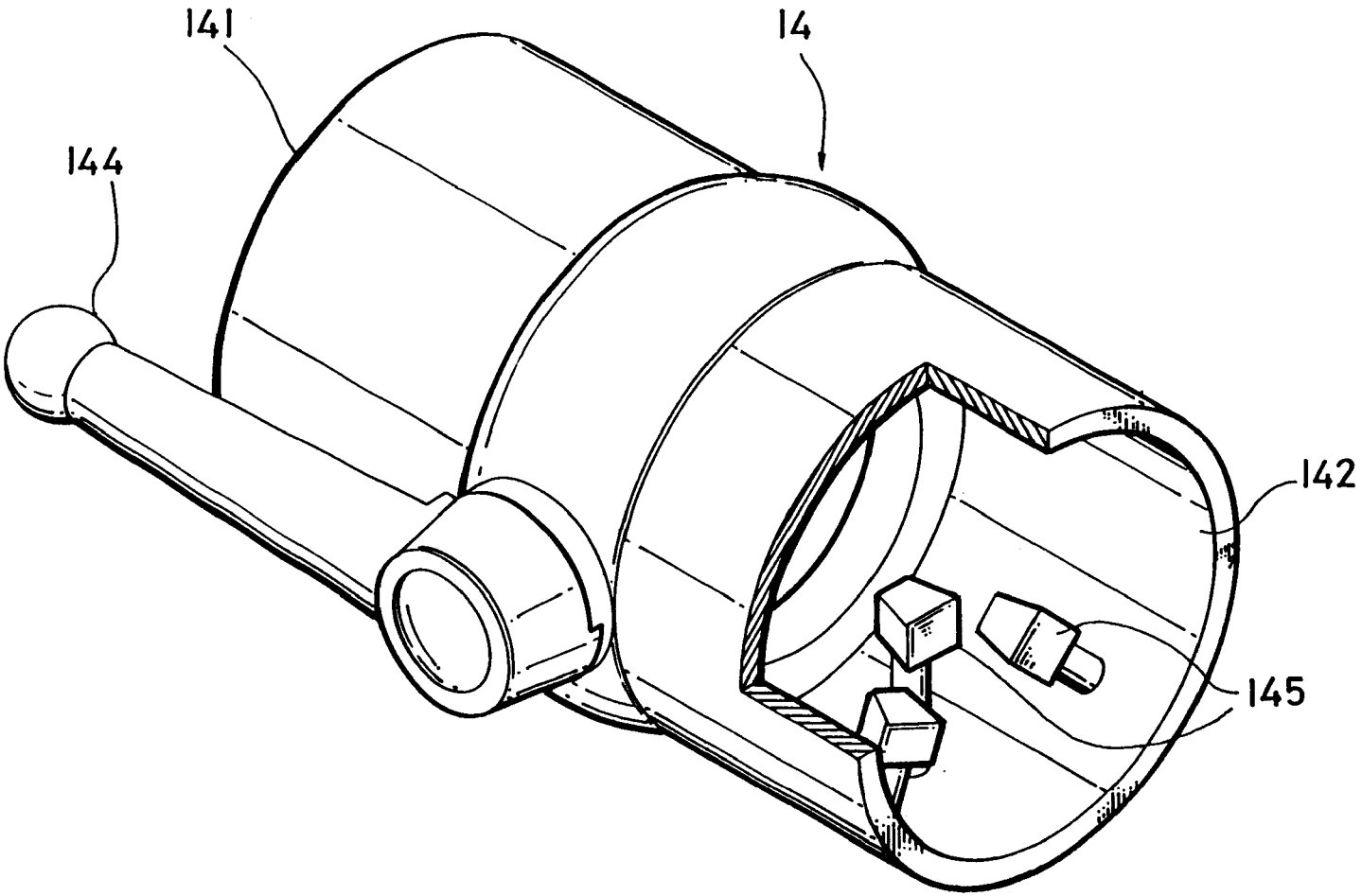
FIG. 4 is a cutaway view of the control valve shown in FIG. 2.

A driving device 12 is installed in the casing 10, having a water pipe 13 vertically upwardly extended from the top output end thereof. The driving device 12 can be, for example, a motor-pump, which pumps the liquid from the casing 10 into the water pipe 13 for circulation. The water pipe 13 has a bottom end connected to the motor-pump 12, and an opposite end turned downwards and mounted with a control valve 14. The control valve 14 comprises a water inlet 141 connected to the water pipe 13, a water outlet 142 disposed outside the water pipe 13 and aimed at the casing 10 (see FIG. 1), and a valve block 143 disposed between the water inlet 141 and the water outlet 142, a lever 144 disposed on the outside for operation by hand to turn the valve block 143 in regulating the flow rate of water passing from the water inlet 141 and the water outlet 142 (see FIGS. 1 and 4), and a plurality of baffles 145 respectively raised from the inside wall thereof inside the water outlet 142 (see FIGS. 2, 3 and 4). When the liquid passes through the control valve 14 to the water outlet 142, the baffles 145 baffle the liquid, forming a waterfall. According to the present preferred embodiment, the baffles 145 have a trapezoidal profile (see FIG. 4).

A meshed plate 15 is mounted in the casing 10 above the overflow port 101, having open spaces 151 in it. Through the open spaces 151, the waterfall falls from the water outlet 142 of the control valve 14 to the inside of the casing 10. The meshed plate 15 is preferably a wooden plate suitable for sitting.

A control device 16 is mounted on the casing 10 on the outside (see FIG. 1) for controlling the operation of water therapy apparatus 1. The control device 16 has electric leakage protection means (not shown) connected to a grounding terminal (not shown) at the bottom side of the casing 10.

A waterproof curtain 18 is suspended above the casing 10 to prevent the waterfall from splashing over the floor (see FIG. 1).

When in use, the user can sit on the meshed plate 15 in the casing 10, and then operate the control device 16 to turn on the motor-pump 12. When starting the motor-pump 12, the liquid which is carried in the casing 10 is pumped into the water pipe 13, and forced to flow out of the control valve 14, and therefore a waterfall is produced and fell to pound on the body of the user, causing the user's muscles and circulation of blood to be stimulated.

While only one embodiment of the present invention has been shown and described, it will be understood that various modifications and changes could be made thereunto without departing from the spirit and scope of the invention disclosed.

What the invention claimed is:

1. A water therapy apparatus comprising:

a casing holding a liquid, said casing having an upwardly extended water pipe;

driving means mounted inside said casing and controlled to pump said liquid into said water pipe;

a control valve mounted on one end of said upwardly extended water pipe remote from said casing for causing the liquid passing through said upwardly extended water pipe to form a waterfall falling toward said casing, said control valve comprising a water inlet connected to said upwardly extended water pipe, a water outlet facing said casing, a valve block disposed between said water inlet and said water outlet and rotated to regulate the flow rate of the liquid passing out of said upwardly extended water pipe, and a plurality of baffle elements disposed in said water outlet for causing the liquid passing through said valve block to form a waterfall;

a plate mounted in said casing at a top side; and a control device mounted on said casing on the outside for controlling said driving means to pump the liquid from said casing into said upwardly extended water pipe.

2. The water therapy apparatus of claim 1 wherein said casing further comprises an overflow port and a drain port.

3. The water therapy apparatus of claim 2 wherein said casing has a bottom wall sloping downwards toward said drain port.

4. The water therapy apparatus of claim 1 wherein said driving means is a motor-pump.

5. The water therapy apparatus of claim 1 wherein said control valve comprises a lever disposed on the outside for turning said valve block in regulating the flow rate of the liquid passing out of said upwardly extended water pipe.

6. The water therapy apparatus of claim 1 wherein said baffle elements have a trapezoidal profile.

7. The water therapy apparatus of claim 1 wherein said plate is a meshed wooden plate having open spaces through which the waterfall passes from said control valve to the inside of said casing.

8. The water therapy apparatus of claim 1 wherein said casing comprises a grounding terminal at a bottom side thereof to prevent an electric leakage.

9. The water therapy apparatus of claim 1 wherein said control device comprises electric leakage protection means.

10. The water therapy apparatus of claim 1 further comprising a waterproof curtain suspended above said casing to prevent the waterfall falling from said control valve from splashing over surrounding area outside said casing.

* * * * *